US008261655B2

(12) United States Patent
Teschke et al.

(10) Patent No.: US 8,261,655 B2
(45) Date of Patent: Sep. 11, 2012

(54) LOCKING PISTON ASSEMBLY

(75) Inventors: Ulrich Teschke, Rheinberg (DE); Martin Engels, Alpen (DE)

(73) Assignee: Norgren GmbH, Alpen (DE)

( * ) Notice: Subject to any disclaimer, the term of this patent is extended or adjusted under 35 U.S.C. 154(b) by 896 days.

(21) Appl. No.: 12/374,083

(22) PCT Filed: Jul. 28, 2006

(86) PCT No.: PCT/EP2006/007513
§ 371 (c)(1),
(2), (4) Date: Jan. 16, 2009

(87) PCT Pub. No.: WO2008/011910
PCT Pub. Date: Jan. 31, 2008

(65) Prior Publication Data
US 2009/0266228 A1 Oct. 29, 2009

(51) Int. Cl.
*F15B 15/26* (2006.01)
*F15B 11/00* (2006.01)

(52) U.S. Cl. ..... 92/27; 91/45; 92/26

(58) Field of Classification Search ..... 91/45; 92/23, 92/26, 27, 28
See application file for complete search history.

(56) References Cited

U.S. PATENT DOCUMENTS

| | | | | |
|---|---|---|---|---|
| 2,181,562 | A * | 11/1939 | De Ganahl et al. | 92/27 |
| 4,248,138 | A | 2/1981 | Akkerman | |
| 4,703,683 | A | 11/1987 | Sue | |
| 4,784,037 | A | 11/1988 | Fabyan et al. | |
| 5,063,828 | A | 11/1991 | Kamimura | |
| 6,832,540 | B2 | 12/2004 | Hart | |
| 7,299,739 | B2 * | 11/2007 | Nakata et al. | 91/43 |
| 2006/0096786 | A1 | 5/2006 | Wells | |

FOREIGN PATENT DOCUMENTS

| | | | |
|---|---|---|---|
| DE | 2146592 | A1 | 3/1973 |
| DE | 202005018038 | u1 | 12/2006 |
| JP | 50050571 | A | 5/1975 |
| WO | WO 2004067971 | A1 * | 8/2004 |

* cited by examiner

*Primary Examiner* — Thomas E Lazo
(74) *Attorney, Agent, or Firm* — Ollila Law Group LLC

(57) ABSTRACT

A locking piston assembly (100) is provided according to the invention. The locking piston assembly (100) includes a piston chamber (107), a piston rod (106) configured to be substantially extended from and substantially retracted into the piston chamber (107), and a piston head (108) coupled to the piston rod (106) and configured to move reciprocally in the piston chamber (107). The locking piston assembly (100) further includes at least one lock (120) configured to mechanically lock the piston head (108) and the piston rod (106) in at least a substantially fully extended position. The lock (120) is configured to unlock the piston head (108) and the piston rod (106) in a presence of a pressurized fluid provided to retract the piston rod ( 106). The pressurized fluid is introduced into the piston chamber (107) and the piston rod (106) is retracted only after the lock (120) is unlocked.

18 Claims, 8 Drawing Sheets

LOCKING PISTON ASSEMBLY

BACKGROUND OF THE INVENTION

1. Field of the Invention

The present invention relates to a piston assembly, and more particularly, to a locking piston assembly.

2. Statement of the Problem

A piston assembly comprises a piston head positioned in a piston chamber. The piston head moves reciprocally in the piston chamber in response to the introduction and/or removal of a pressurized liquid or a pressurized gas. One type of piston assembly is a piston actuator that can be used to convert fluid pressure into mechanical work or vice versa. The piston head is coupled to a piston rod. The piston rod can be connected to any manner of mechanism or device, wherein the piston assembly can be operated in a reciprocating manner and therefore can be used to perform mechanical work.

In some applications, it is desirable that the actuator be locked in an extended position, be locked in a retracted position, or both. For example, in industrial or manufacturing equipment, a locking piston assembly may be needed for purposes of safety of human operators. This includes a locking capability in the event of the loss of a pressurizing fluid used in the piston assembly.

In the prior art, a mechanical lock typically includes a pin or tab that must hold the piston head and piston rod against a force created by a pressurized hydraulic fluid. This forces the lock mechanism to be unnecessarily robust, large, and heavy.

SUMMARY OF THE INVENTION

A locking piston assembly is provided according to an embodiment of the invention. The locking piston assembly comprises a piston chamber, a piston rod configured to be substantially extended from and substantially retracted into the piston chamber, and a piston head coupled to the piston rod and configured to move reciprocally in the piston chamber. The locking piston assembly further comprises at least one lock configured to mechanically lock the piston head and the piston rod in at least a substantially fully extended position and configured to unlock the piston head and the piston rod in a presence of a pressurized fluid provided to retract the piston rod. The pressurized fluid is introduced into the piston chamber and the piston rod is retracted only after the at least one lock is unlocked.

A locking piston assembly is provided according to an embodiment of the invention. The locking piston assembly comprises a piston chamber, a piston rod configured to be substantially extended from and substantially retracted into the piston chamber, and a piston head coupled to the piston rod and configured to move reciprocally in the piston chamber. The locking piston assembly further comprises at least one latch ring extending from the piston head and at least one lock configured to engage the at least one latch ring in order to mechanically lock the piston head and the piston rod in at least a substantially fully extended position in an absence of a pressurized fluid in the lock. The at least one lock is configured to disengage the at least one latch ring in order to unlock the piston head and the piston rod upon introduction of the pressurized fluid that is provided to retract the piston rod.

A method of unlocking a piston rod of a locking piston assembly is provided according to an embodiment of the invention. The method comprises providing pressurized fluid against an inlet region of a locking member of a lock in opposition to a normally-closed biasing force. The pressurized fluid moves the locking member in opposition to the biasing force and to an unlocked position. The method further comprises the locking member unblocking a piston chamber port extending to a piston chamber. The unblocking occurs substantially at an end of an opening travel of the locking member. The pressurized fluid travels into the piston chamber and causes the retraction of the piston rod.

ASPECTS OF THE INVENTION

In one embodiment of the locking piston assembly, the at least one lock locks the piston head and the piston rod in a substantially fully retracted position.

In another embodiment of the locking piston assembly, the at least one lock locks the piston head and the piston rod in an absence of a pressurized fluid in the at least one lock.

In yet another embodiment of the locking piston assembly, the locking piston assembly further comprises at least one latch ring extending from the piston head, with the at least one lock engaging the at least one latch ring.

In yet another embodiment of the locking piston assembly, the locking piston assembly further comprises at least one latch ring extending from the piston head and a lock groove formed in the at least one latch ring, with the at least one lock engaging the lock groove of the at least one latch ring.

In yet another embodiment of the locking piston assembly, the at least one lock further comprises a biasing member, a locking member, a locking member upper seal configured to continuously seal the locking member to a lock bore configured to receive the locking member, and a locking member lower seal configured to block and unblock a piston chamber port extending between the lock bore and a piston chamber, wherein the locking member and the locking member lower seal block the piston chamber port when in a lock position and unblock the piston chamber port when in an unlock position.

In yet another embodiment of the locking piston assembly, an upper seal cross-sectional area is greater than a lower seal cross-sectional area, wherein the lower seal cross-sectional area requires a first pressure to move the locking member to an open position and the upper seal cross-sectional area requires a second pressure to keep the locking member at the open position, and wherein the first pressure is greater than the second pressure.

In yet another embodiment of the locking piston assembly, an unlocking operation comprises providing pressurized fluid against an inlet region of the locking member in opposition to a normally-closed biasing force, with the pressurized fluid moving the locking member in opposition to the biasing force and to an unlocked position, and the locking member unblocking a piston chamber port extending to a piston chamber, with the unblocking occurring substantially at an end of opening travel of the locking member, wherein the pressurized fluid travels into the piston chamber and causes the retraction of the piston rod.

In yet another embodiment of the locking piston assembly, the pressurized fluid is introduced into the piston chamber and the piston rod is retracted only after the at least one lock is unlocked.

In one embodiment of the method, the piston rod of the locking piston assembly is locked in at least a substantially fully extended position by the lock.

In another embodiment of the method, the piston rod of the locking piston assembly is locked in at least a substantially fully retracted position by the lock.

In yet another embodiment of the method, the moving moves the locking member substantially out of engagement with a latch ring extending from a piston head that is coupled to the piston rod.

In yet another embodiment of the method, the moving moves the locking member substantially before an extension or retraction force is placed on the piston rod.

In yet another embodiment of the method, the unblocking occurs during an opening travel of the locking member.

In yet another embodiment of the method, the unblocking occurs substantially at an end of an opening travel of the locking member.

DESCRIPTION OF THE DRAWINGS

The same reference number represents the same element on all drawings. It should be understood that the drawings are not necessarily to scale.

DETAILED DESCRIPTION OF THE INVENTION

FIGS. 1-8 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
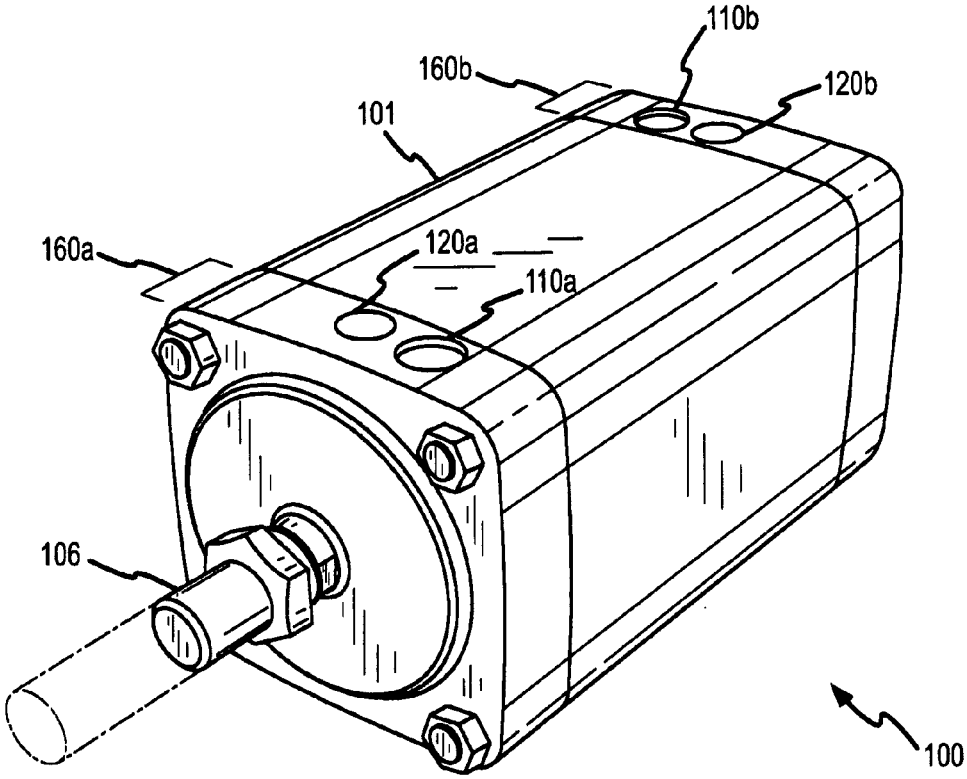
FIG. 1 shows a locking piston assembly according to an embodiment of the invention.

FIG. 1 shows a locking piston assembly 100 according to an embodiment of the invention. Components in common with other figures share reference numbers. The locking piston assembly 100 includes a piston body 101, one or more end caps 160, and a piston rod 106. The piston rod 106 can be retracted into the piston body 101 (solid lines) and can be extended from the piston body 101 (dashed lines).

The locking piston assembly 100 can be operated by introduction of a pressurized fluid into the piston body 101 through ports 110. The pressurized fluid in one embodiment comprises a liquid, such as a hydraulic fluid, for example. The pressurized fluid in another embodiment comprises a gas, such as air, for example.

The locking piston assembly 100 includes at least one lock 120 formed in an end cap 160. The lock 120 mechanically locks the piston rod 106. In the embodiment shown, the locking piston assembly 100 includes two end caps 160*a* and 160*b* and two locks 120*a* and 120*b* at both ends of the piston body 101. When the lock 120*a* in the end cap 160*a* is actuated, then the piston rod 106 can be locked in a fully extended position. Alternatively, when the lock 120*b* in the opposite end cap 160*b* is actuated, then the piston rod 106 can be locked in a fully retracted position. Alternatively, the locking piston assembly 100 can include two locks 120*a* and 120*b*. wherein the piston rod 106 can be locked at both the extended and retracted positions.

Because the lock 120 is formed in the end cap 160, the lock 120 can be easily installed to the locking piston assembly 100. Furthermore, the lock 120 can be easily accessed for maintenance and/or repair.

It should be understood that various numbers of locks 120 can be included in an individual end cap. One lock 120 is shown in an end cap 160 for the purpose of simplicity. However, multiple locks 120 can be radially positioned in an end cap 160. For example, an end cap 160 could include four symmetrically spaced locks 120 that all engage the latch ring 130.

When locked, the lock 120 remains in the locked position even in the event of loss of pressurized fluid. The lock 120 further cuts off the supply of pressurized fluid, wherein the lock 120 does not have to operate against an internal actuation pressure (see FIGS. 4-6 and the accompanying discussion). In this manner, the lock 120 does not have to be as robust as piston locks in the prior art. The lock 120 only holds the piston rod 106 and associated piston head 108, and does not have to oppose a force generated by a pressurized fluid in the locking piston assembly 100.

FIG. 1 and the following figures show and discuss a lock for a piston assembly. However, it should be understood that the lock can equally apply to valves, including diaphragm valves, spool valves, etc., or other devices employing a pressurized fluid that moves a piston, valve, plunger, etc.

Figure 2:
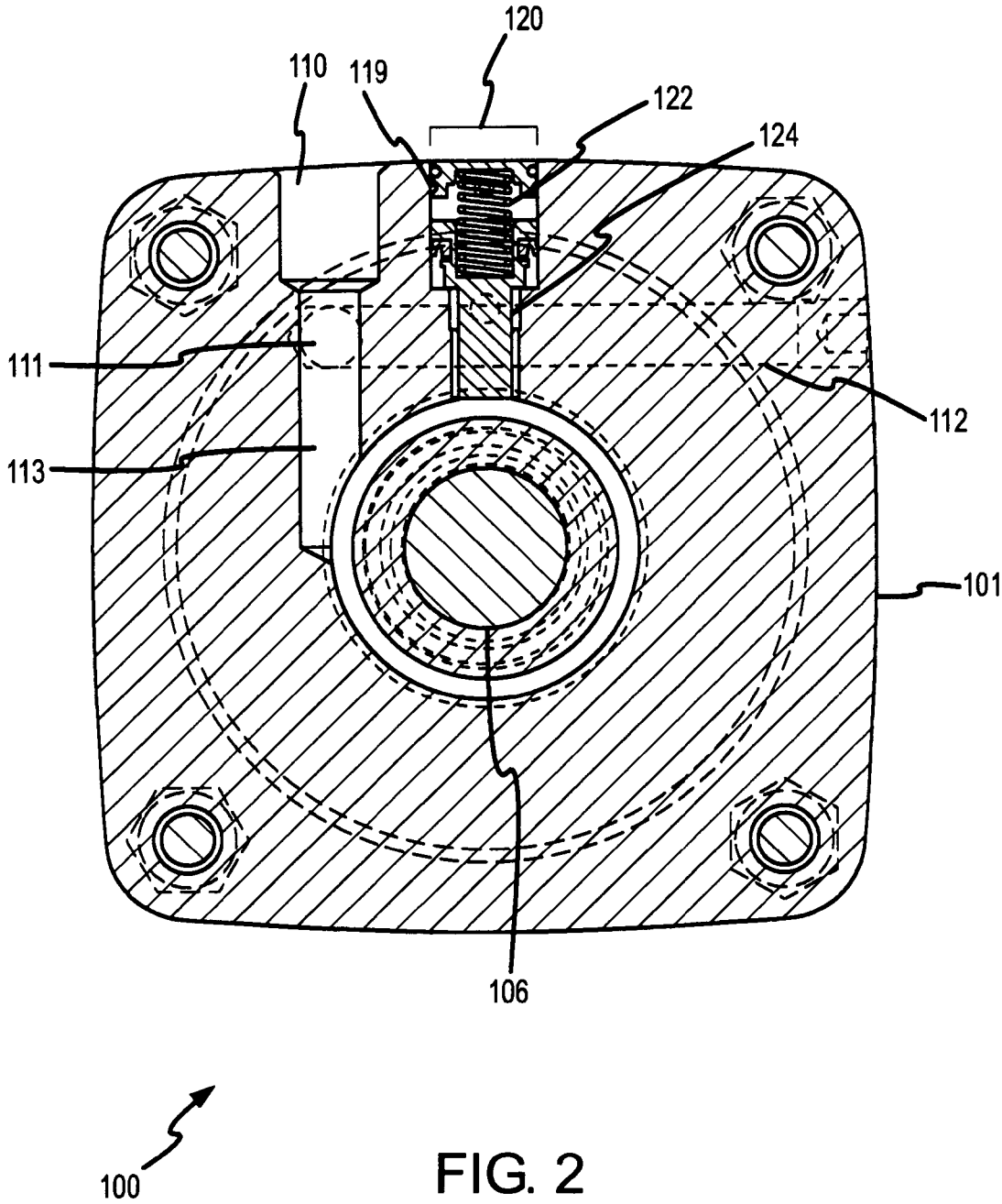
FIG. 2 is an end view of the locking piston assembly according to an embodiment of the invention.

FIG. 2 is an end view of the locking piston assembly 100 according to an embodiment of the invention. The lock 120 includes a locking member 124 and a biasing device 122 that urges the locking member 124 down into engagement with a latch ring 130 of the piston rod 106 or piston head 108. In addition, the end cap 160 includes the port 110, a first cross-connect passage 111 that connects to the port 110, and a second cross-connect passage 112 that connects to the first cross-connect passage 111. The second cross-connect passage 112 communicates with the lock 120. A pressurized fluid can flow to and from the lock 120 via the port 110, the first cross-connect passage 111, and the second cross-connect passage 112.

Figure 3:
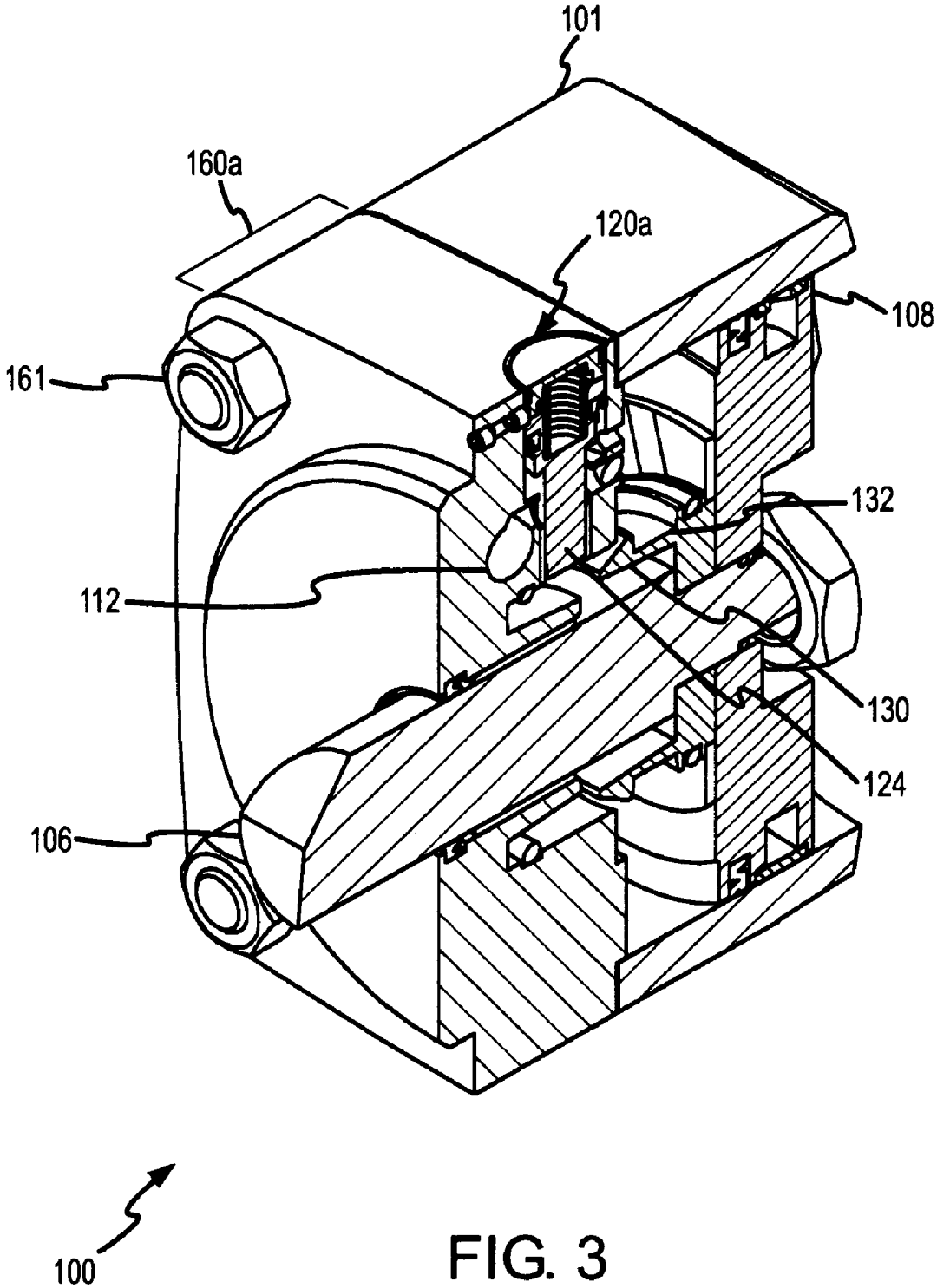
FIG. 3 is a cutaway perspective view of the locking piston assembly according to an embodiment of the invention.

FIG. 3 is a cutaway perspective view of the locking piston assembly 100 according to an embodiment of the invention. The figure shows the piston body 101 including an end cap 160 and the second cross-connect passage 112. It can be seen that the second cross-connect passage 112 delivers pressurized fluid to an inlet region 117 of the lock 120*a* in one embodiment. Although only one lock 120*a* is shown, the figure applies to both locks 120*a* and 120*b*.

A piston head 108 is positioned in and moves in a piston chamber 107 in the piston body 101 in response to introduction/exhaust of pressurized fluid. The piston head 108 is coupled to the piston rod 106. The piston head 108 includes a latch ring 130 that is engaged by the locking member 124 of the lock 120 (see also FIGS. 4-6). The latch ring 130 includes a lock groove 132 that receives an end of the locking member 124. The latch ring 130 extends from the piston head 108. In one embodiment, the latch ring 130 is formed as part of the piston head 108 or piston rod 106. Alternatively, the latch ring 130 can be affixed to these two components in some manner.

It can be seen from this figure that the locking member 124 engages the lock groove 132 and the latch ring 130 only when the piston rod 106 and the piston head 108 are at a fully extended position. The lock 120*a* therefore locks the piston rod 106 in the fully extended position. As a consequence, when the piston rod 106 is at the fully extended position, the lock 120*a* prevents retraction. This is true even in the event of a loss of the pressurized fluid in the locking piston assembly 100. Therefore, the lock 120*a* can maintain the piston rod 106 in the fully extended position. It should be remembered that the lock 120*b* can similarly lock the locking piston assembly 100 when the piston rod 106 is in a fully retracted position.

The biasing device 122 of the lock 120 pushes the locking member 124 downward. In the absence of pressurized fluid to actuate the lock 120, the biasing device 122 will force the locking member 124 down into the lock groove 132.

It can be seen from the figure that the piston head 108 and the latch ring 130 can rotate and yet not affect the operation of the lock 120. Therefore, the piston head 108 and the piston rod 106 do not need to be constrained against rotation.

Figure 4:
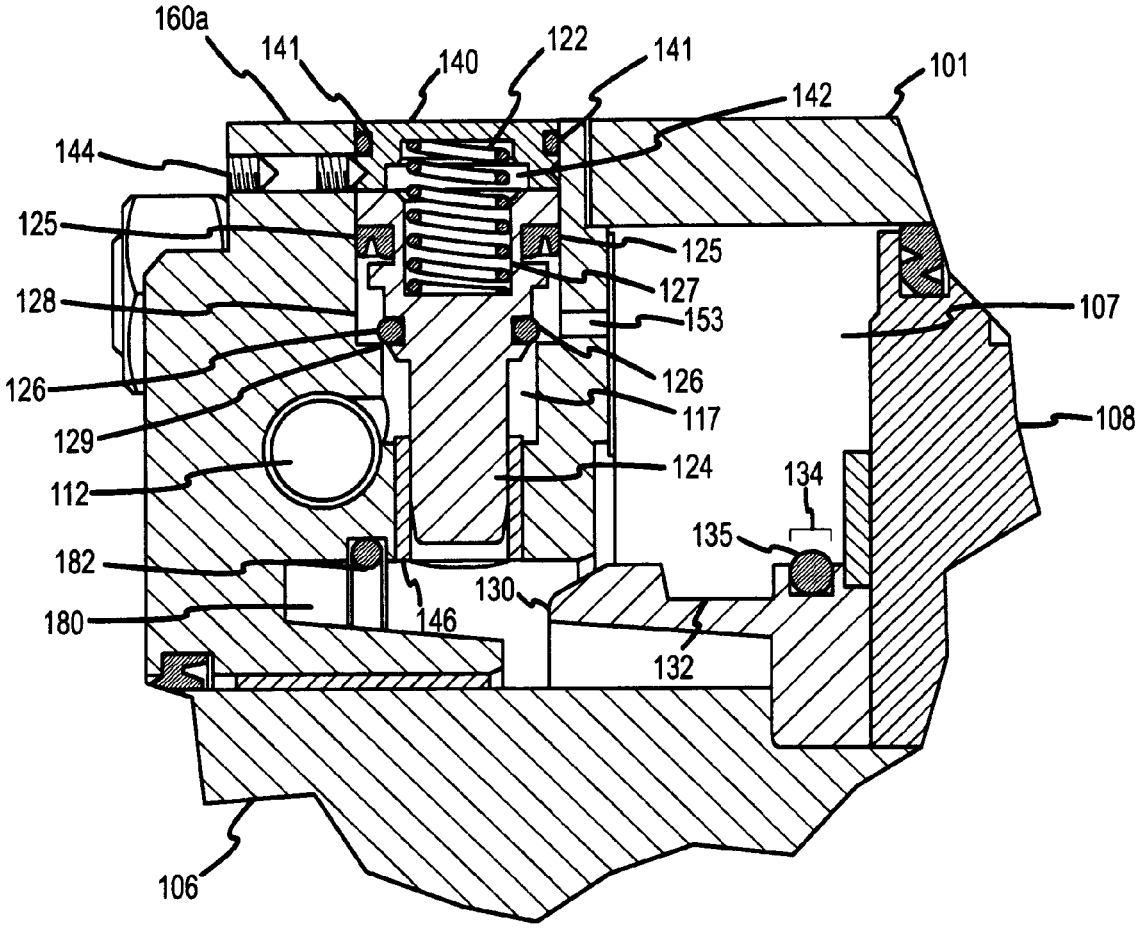
FIG. 4 is an enlarged cross-sectional view of a region of the locking piston assembly including the lock.

FIG. 4 is an enlarged cross-sectional view of a region of the locking piston assembly 100 including the lock 120. This figure shows all relevant components of the lock 120. In this figure, the piston rod 106 is between retracted and extended positions. As a result, there is pressurized fluid in the piston chamber 107 and in the second cross-connect passage 112. The lock 120 cannot engage, and the piston rod 106 is moved by regulation of the pressurized fluid.

The lock 120 includes a top cap 140 and top cap seal 141. The top cap 140 fits into a lock bore 128 in the end cap 160 and affixes to the end cap 160. The lock bore 128 can include one or more bore portions. The top cap 140 in one embodiment is affixed to the end cap 160 by one or more set screws 144 (see also FIGS. 1 and 3). The top cap 140 further includes a top cap chamber 142 for receiving a portion of the biasing device 122.

The locking member 124 further includes a locking member chamber 127 for receiving the biasing device 122. In addition, the locking member 124 includes a locking member upper seal 125 and a locking member lower seal 126. Both the upper seal 125 and the lower seal 126 engage the lock bore 128 and enable the locking member 124 to move reciprocally in the lock bore 128. The upper seal 125 is in continuous contact with the lock bore 128. In contrast, the lower seal 126 in the embodiment shown can come into contact with and move away from a shoulder 129 formed in the lock bore 128.

The lock 120 is received in the lock bore 128 formed in the end cap 160. The lock bore 128 extends down to a latch ring bore 180 in the end cap 160. The latch ring bore 180 corresponds to and receives the latch ring 130. The latch ring bore 180 in one embodiment is substantially annular in shape. The latch ring bore 180 includes a latch ring bore seal 182 that fits to the latch ring 130 when the piston rod 106 is substantially fully extended.

The latch ring 130 further includes a latch ring seal groove 134 and a latch ring seal 135. The latch ring seal 135 seals the piston head 108 to the end cap 160 when the piston rod 106 is substantially fully extended.

When pressurized fluid is introduced into the piston chamber 107, the piston head 108 will move to the right in the figure and the piston rod 106 will be retracted. The pressurized fluid is introduced through the second cross-connect passage 112, around the locking member 124, up to the piston chamber port 153, and then through the piston chamber port 153 into the piston chamber 107. It should be understood that correspondingly the fluid on the right of the piston head 108 is vented.

It should be noted that when the latch ring bore seal 182 loses contact with the latch ring 130 and the latch ring seal 135 loses contact with the end cap 160, then a maximum area of the piston head 108 is subjected to the pressurized fluid. The pressurized fluid is supplied at a large volume by the bore 113 of FIG. 2. As a result, a maximum force acts on the piston head 108 to retract the piston rod 106.

In some embodiments, an upper seal cross-sectional area is greater than a lower seal cross-sectional area. Therefore, the lower seal cross-sectional area requires a first pressure to move the locking member to an open position and the upper seal cross-sectional area requires a second pressure to keep the locking member at the open position. In some embodiments, the first pressure is greater than the second pressure.

When pressurized fluid is vented from the second cross-connect passage 112 and therefore the piston chamber 107, the piston head 108 will move to the left in the figure. It should be understood that the venting will be accompanied by a supply of pressurized fluid to a second piston chamber (not shown) on the right side of the piston head 108.

Figure 5:
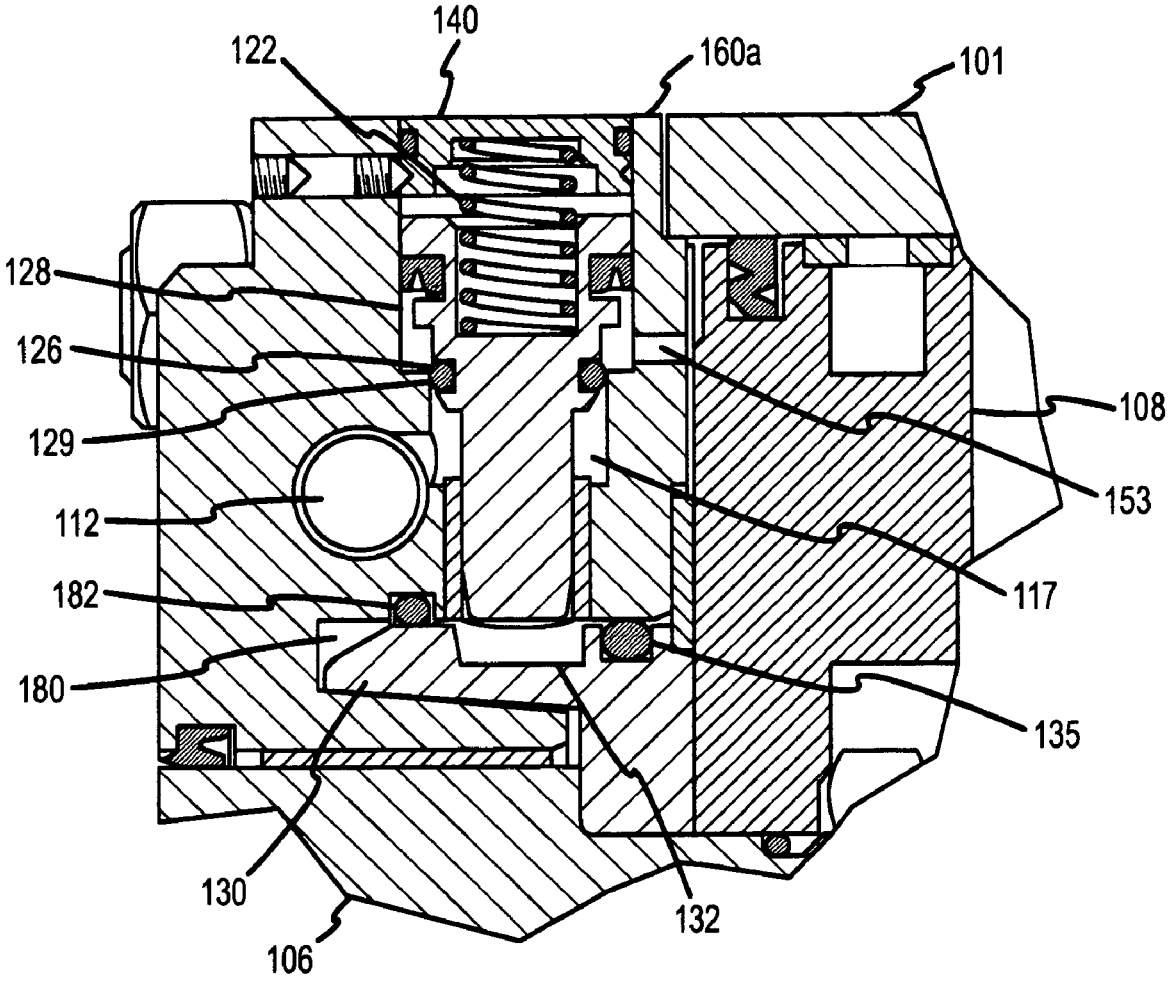
FIG. 5 shows the enlarged cross-sectional view where the locking member remains in an unlock position, but where full extension of the piston rod has been completed.

FIG. 5 shows the enlarged cross-sectional view where the locking member 124 remains in an unlocked position, but where full extension of the piston rod 106 has been completed. When the piston head 108 is substantially in contact with the end cap 160, then the latch ring 130 will enter the latch ring bore 180 and the latch ring bore seal 182 will contact the latch ring 130. In addition, the latch ring seal 135 will contact the end cap 160. The lock 120 can now be actuated and moved into engagement with the latch ring 130. Therefore, pressurized fluid is maintained on the right side of the piston head 108 and pressurized fluid continues to be vented from the second cross-connect passage 112. However, in this figure, the pressure in the inlet region 117 has not yet substantially dropped and therefore the locking member 124 is still in the unlocked position.

Figure 6:
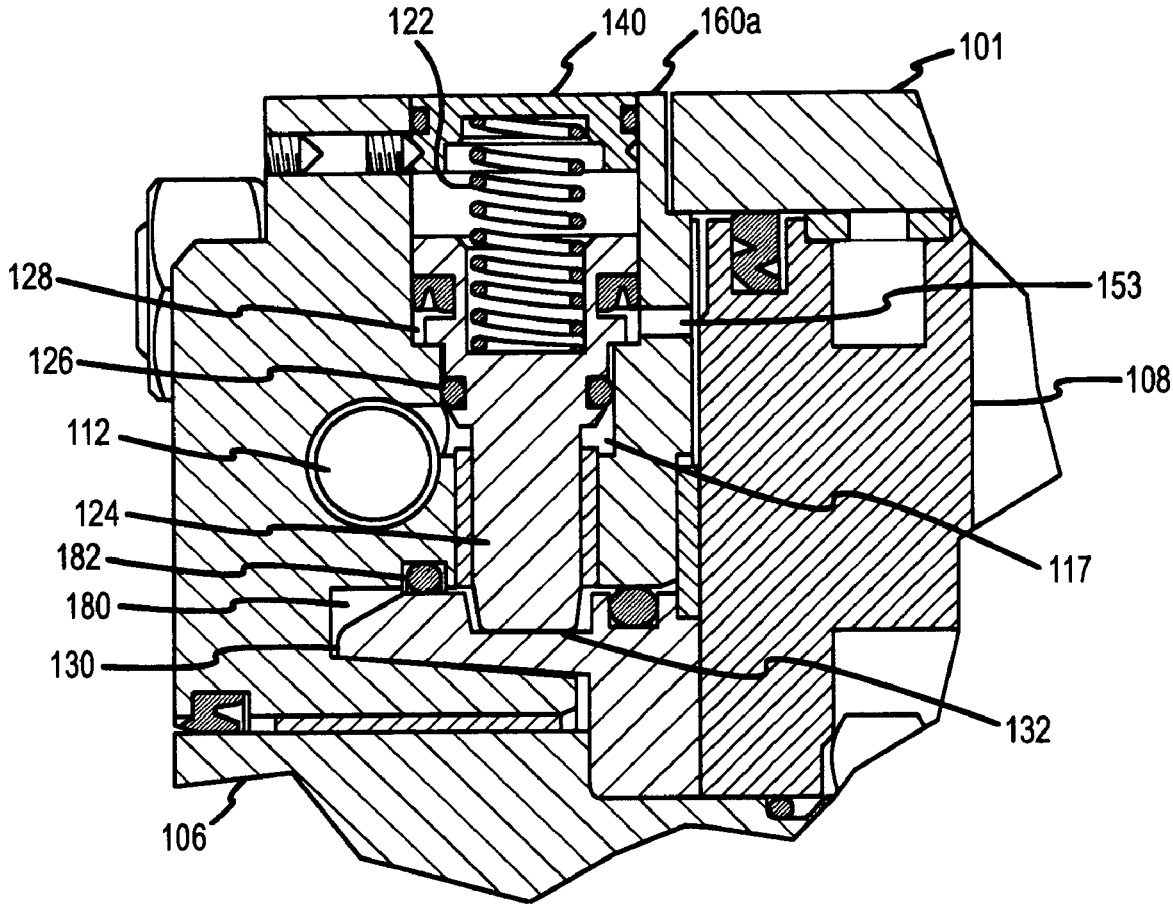
FIG. 6 shows the enlarged cross-sectional view when the locking piston assembly is fully locked.

FIG. 6 shows the enlarged cross-sectional view when the locking piston assembly 100 is fully locked. In this figure, the venting of pressurized fluid from the inlet region 117 (and therefore from the piston chamber 107) has continued until the piston head 108 contacts the end cap 160. During the venting, due to the available surface area of the upper region of the locking member 124, pressure on the locking member 124 will remain at a sufficient level to overcome the biasing device 122 and keep the locking member 124 in an upward, unlocked position.

However, as the pressure drops below a predetermined holding level, the locking member 124 is forced downward into a locking position by the biasing device 122. As a result, the locking member lower seal 126 contacts the shoulder 129 of the lock bore 128, thereby sealing the lock bore 128. As a result, any pressurized fluid in the second cross-connect passage 112 cannot pass up through the lock bore 128 into the piston chamber port 153.

At this time, the locking member 124 drops into the locking groove 132 of the latch ring 130. The piston rod 106 is therefore locked at a fully extended position.

Although the locking operation has been illustrated and discussed for the lock 120*a* and therefore for a lock operation at a full extension of the piston rod 106, it should be understood that the locking operation equally applies to the lock 120*b* and therefore for a lock operation at a full retraction of the piston rod 106.

Unlocking is essentially the reverse of the locking operation. When unlocking commences, pressurized fluid is first vented from the right side of the piston head 108 (see FIG. 6). Then, pressurized fluid is introduced into the inlet region 117 through the second cross-connect passage 112. The pressurized fluid counteracts the biasing device 122 and moves the locking member 124 upward to an unlock position (see FIG. 5). The movement of the locking member 124 to the unlock position is a first step in the piston rod retraction operation. When the locking member lower seal 126 lifts up and away from the shoulder 129 in order to move the piston head 108, the locking member 124 has already been retracted from the latch ring 130. Therefore, the piston rod 106 cannot move before it is unlocked. When the locking member 124 has moved fully upward, then the pressurized fluid can travel through the piston chamber port 153 into the piston chamber 107, causing the piston head 107 to move to the right and retract the piston rod 106 (see FIG. 4). Until the lower seal 126 loses contact with the lock bore 128, the opening pressure provided by the pressurized fluid will press upward on the locking member 124. Therefore, in operation, the locking member 124 will move fully upward if a satisfactory pressure is provided by the pressurized fluid. The required lifting pressure is controlled by the biasing force provided by the biasing device 122, in combination with the available diameter/area of the locking member 124 and the locking member lower seal 126. The pressure required to move the locking member 124 to the open position is greater than a pressure required to maintain the locking member 124 in the unlock position. However, the pressure supplied by the second cross-connect passage 112 in one embodiment will easily exceed the pressure needed to lift the locking member 124.

Figure 7:
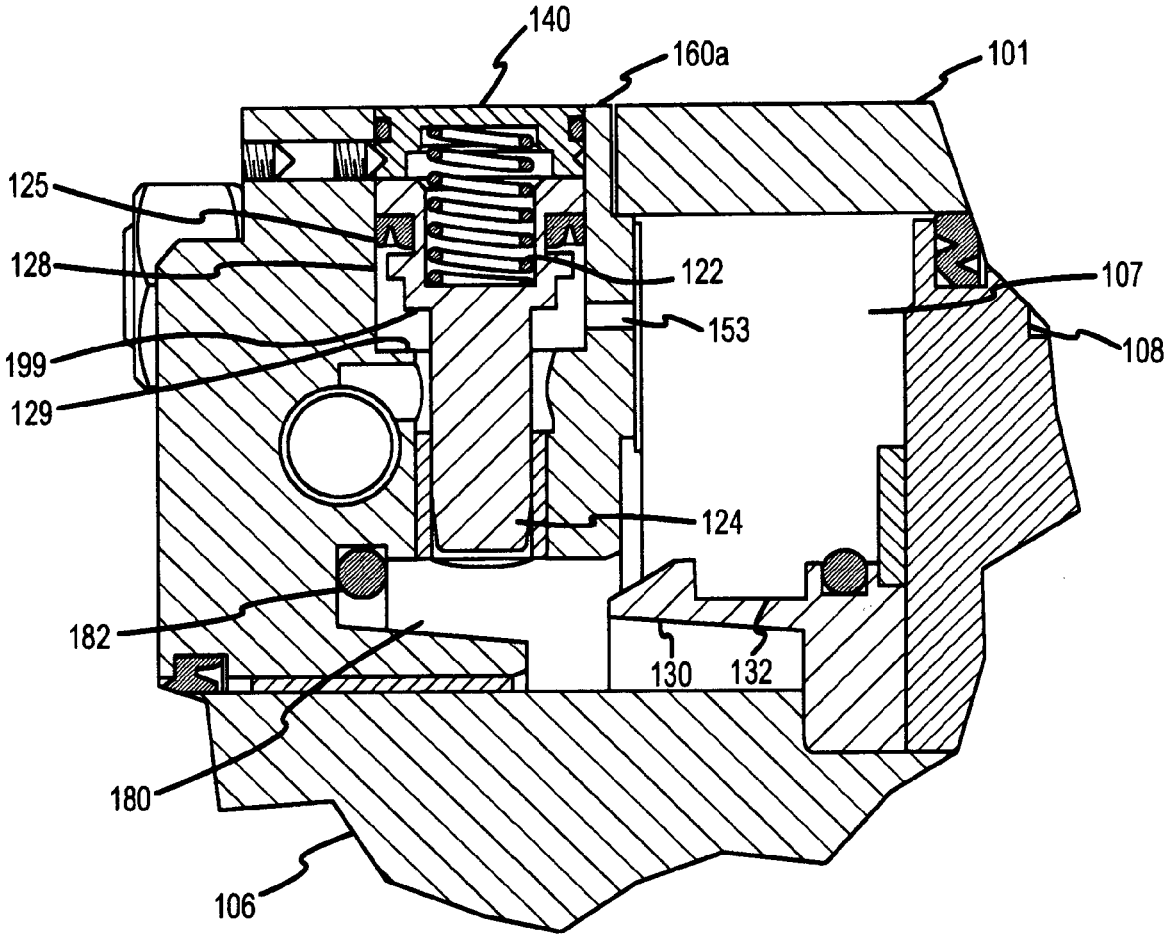
FIG. 7 shows an enlarged cross-sectional view of an embodiment of the invention.

FIG. 7 shows an enlarged cross-sectional view of an embodiment of the invention. In this embodiment, the locking member 124 includes the locking member upper seal 125. Instead of the locking member lower seal 126, in this embodiment the locking member 124 includes a shoulder 199 that seats onto and overhangs the shoulder 129 of the lock bore 128. This shoulder-to-shoulder contact can seal the piston chamber port 153 from the second cross-connect passage 112. Alternatively, any manner of seal, gasket, etc., can be further included between the two components, including a seal positioned on the shoulder 129 of the lock bore 128.

Figure 8:
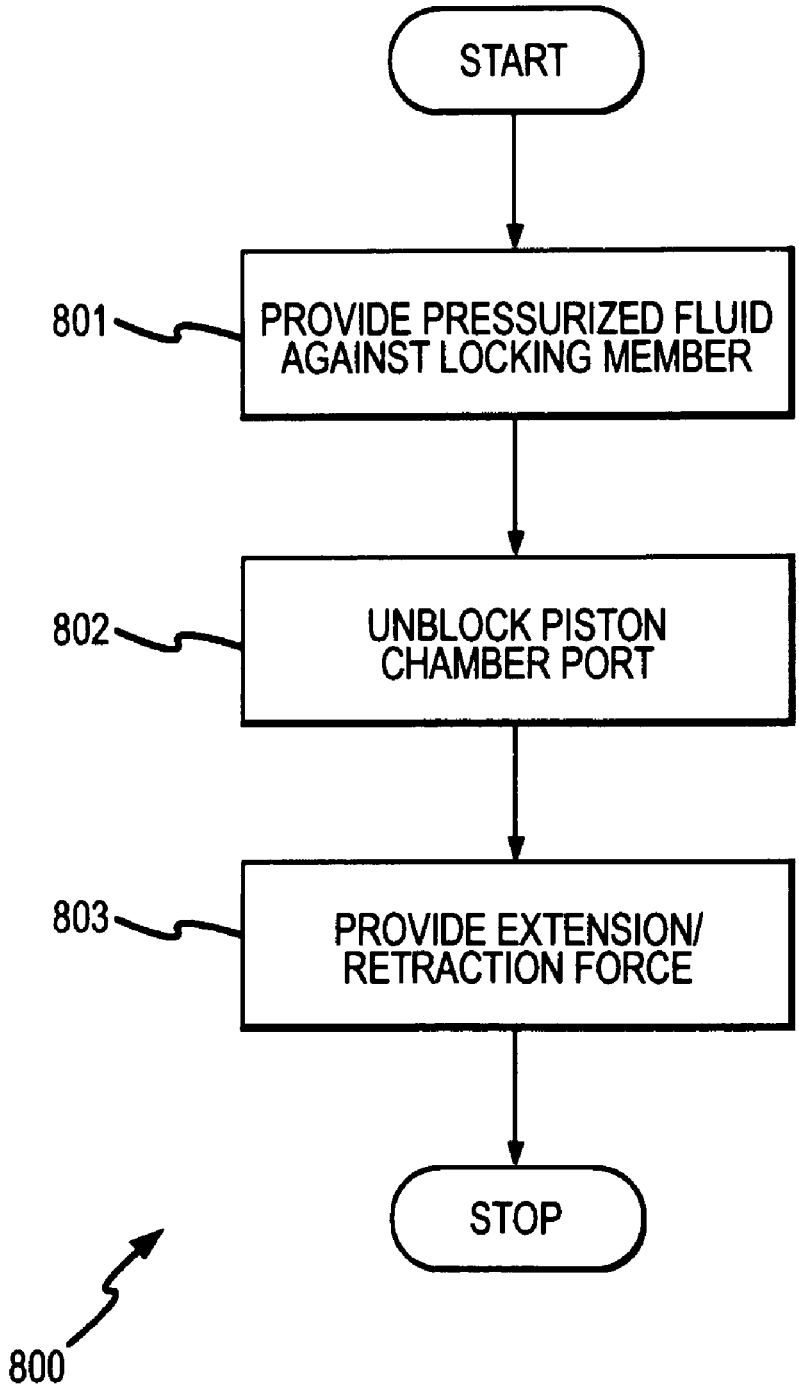
FIG. 8 is a flowchart of a method of unlocking a piston rod of a locking piston assembly according to an embodiment of the invention.

FIG. 8 is a flowchart 800 of a method of unlocking a piston rod of a locking piston assembly according to an embodiment of the invention. In step 801, a pressurized fluid is provided against a locking member. The locking member locks a piston head/piston rod of the locking piston assembly. The locking member can lock the piston head/piston rod in a fully extended position or in a fully retracted position. The pressurized fluid can comprise a pressurized liquid or a pressurized gas, as previously discussed. The pressurized fluid is provided against an inlet region of the locking member and is in opposition to a normally-closed biasing force. The biasing force is provided by a biasing device, as previously discussed. As a result of the introduction of the pressurized fluid, the locking member is moved in opposition to the biasing force and is therefore moved into an unlocked position. Consequently, the locking member is moved out of engagement with a latch ring that extends from a piston head that is coupled to the piston rod. The moving moves the locking member before an extension or retraction force is placed on the piston rod.

In step 802, the movement of the locking member unblocks a piston chamber port. The piston chamber port extends between a piston chamber and a source of pressurized fluid, such as a second cross-connect passage in one embodiment. Pressurized fluid therefore can travel into the piston chamber and can move the piston head. In one embodiment, the unblocking occurs during an opening travel of the locking member. In another embodiment, the unblocking occurs substantially at an end of an opening travel.

In step 803, an extension/retraction force can be provided into the piston chamber via the piston chamber port. The extension/retraction force is provided by regulation of the pressurized fluid. If the lock is located on a piston rod end of the of the locking piston assembly (as in FIGS. 3-7), then a retraction force is provided by the piston chamber port. However, if the lock is located at an opposite end of the locking piston assembly (see lock 120*b* of FIG. 1), then an extension force is provided by the piston chamber port.

The locking piston assembly according to the invention can be employed according to any of the embodiments in order to provide several advantages, if desired. The invention provides a locking piston assembly that mechanically locks in an absence of a pressurized fluid. The invention provides a locking piston assembly that unlocks only upon the introduction of a pressurized fluid. The invention provides a locking piston assembly wherein the lock releases before a pressurized fluid is provided into a piston chamber. The invention provides a locking piston assembly wherein less pressure is required to hold the lock in an unlock position than is required to move the lock to the unlock position. The invention provides a locking piston assembly wherein the lock does not have to counter a force generated by a pressurized fluid in the piston assembly. The invention provides a locking piston assembly wherein the piston head and piston rod do not need to be constrained against rotation. The invention provides a locking piston assembly that does not increase an overall size of the piston assembly.

What is claimed is:

1. A locking piston assembly (100) including a piston chamber (107), a piston rod (106) configured to be substantially extended from and substantially retracted into the piston chamber (107), and a piston head (108) coupled to the piston rod (106) and configured to move reciprocally in the piston chamber (107), with the locking piston assembly (100) being characterized by:

at least one lock (120) configure to mechanically lock the piston head (108) and the piston rod (106) in at least a substantially filly extended position and configured to unlock the piston head (108) and the piston rod (106) in a presence of a pressurized fluid provided to retract the piston rod (106), with the at least one lock (120) comprising:

a biasing member (122);

a locking member (124);

a locking member upper seal (125) configured to continuously seal the locking member (124) to a lock bore (128) configured to receive the locking member (124); and a locking member lower seal (126) configured to block and unblock a piston chamber port (153) extending between the lock bore (128) and piston chamber (107) with an upper cross-sectional area being greater than a lower seal cross-sectional area, wherein the lower seal cross-sectional area requires a first pressure to move the locking member (124) to an open position and the upper seal cross-sectional area requires a second pressure to keep the locking member (124) at the open position , and wherein the first pressure is greater than the second pressure;

wherein the locking member (124) and the locking member (126) block the piston chamber port (153) when in a lock position and unblock the piston chamber port (153) when in an unlock position and wherein the pressurized fluid is introduced into the piston chamber (107) and the piston rod (106) is retracted only after the at least one lock (120) is unlocked.

2. The locking piston assembly (100) of claim 1, with the at least one lock (120) locking the piston head (108) and the piston rod (106) in a substantially fully retracted position.

3. The locking piston assembly (100) of claim 1, with the at least one lock (120) locking the piston head (108) and the piston rod (106) in an absence of a pressurized fluid in the at least one lock (120).

4. The locking piston assembly (100) of claim 1, further comprising at least one latch ring (130) extending from the piston head (108), with the at least one lock (120) engaging the at least one latch ring (130).

5. The locking piston assembly (100) of claim 1, further comprising:

at least one latch ring (130) extending from the piston head (108); and a lock groove (132) formed in the at least one latch ring (130), with the at least one lock (120) engaging the lock groove (132) of the at least one latch ring (130).

6. The locking piston assembly (100) of claim 1. with an unlocking operation comprising:

providing pressurized fluid against an inlet region (117) of the locking member (124) in opposition to a normally-closed biasing force, with the pressurized fluid moving the locking member (124) in opposition to the biasing force and to an unlocked position; and the locking member (124) unblocking a piston chamber port (153) extending to a piston chamber (107), with the unblocking occurring substantially at an end of opening travel of the locking member (124), wherein the pressurized fluid travels into the piston chamber (107) and causes the retraction of the piston rod (106).

7. A locking, piston assembly (100) including a piston chamber (107), a piston rod (106) configured to be substantially extended from and substantially retracted into the piston chamber (107), and a piston head (108) coupled to the piston rod (106) and configured to move reciprocally in the piston chamber (107), with the locking piston assembly (100) being characterized by:

at least one latch ring (130) extending from the piston head (108); and at least one lock (120) configured to engage the at least one latch ring (130) in order to mechanically lock the piston head (108) and the piston rod (106) in at least a substantially fully extended position in an absence of a pressurized fluid in the lock (120) and configured to disengage the at least one latch ring (130) in order to unlock the piston head (108) and the piston rod (106) upon introduction of the pressurized fluid that is provided to retract the piston rod (106), with the at least one lock (120) comprising;

a biasing member(122);

a locking member (124);

a locking member upper seal (125) configured to continuously seal the locking member (124) to a lock bore(128) configured to receive the locking member (124); and a locking member lower seal (126) on red to block and unblock a piston chamber port (153) extending between the lock bore (128) and a piston chamber (107), with an upper seal cross-sectional area being greater than a lower seal cross-sectional area, wherein the lower seal cross-sectional area requires a first pressure to move the locking member (124) to an open position and the upper seal cross-sectional area requires a second pressure to keep the locking member (124) at the open position, and wherein the first pressure is greater than the second pressure;

wherein the locking member (124) and the locking member lower seal (126) block the piston chamber port (153) when in a lock position and unblock the piston chamber port (153) when in an unlock position and wherein the pressurized fluid is introduced into the Mon chamber (107) and the piston rod (106) is retracted only after the at least one lock (120) is unlocked.

8. The locking piston assembly (100) of claim 7, further comprising the at least one lock (120) locking the piston head (108) and the piston rod (106) in a substantially fully retracted position.

9. The locking piston assembly (100) of claim 7, with the at least one lock (120) locking the piston head (108) and the piston rod (106) in an absence of a pressurized fluid in the at least one lock (120).

10. The locking piston assembly (100) of claim 7, further comprising a lock groove (132) formed in the at least one latch ring (130), with the at least one lock (120) engaging the lock groove (132) of the at least one latch ring (130).

11. The locking piston assembly (100) of claim 7, with an unlocking operation comprising:

providing pressurized fluid against an inlet region (117) of the locking member (124) in opposition to a normally-closed biasing force, with the pressurized fluid moving the locking member (124) in opposition to the biasing force and to an unlocked position; and the locking member (124) unblocking a piston chamber port (153) extending to a piston chamber (107), with the unblocking occurring substantially at an end of opening travel of the locking member (124), wherein the pressurized fluid travels into the piston chamber (107) and causes the retraction of the piston rod (106).

12. A method of unlocking a piston rod of a locking piston assembly, the method comprising:

providing pressurized fluid against an inlet region of a locking member of a lock in opposition to a normally-closed biasing force, with the pressurized fluid moving the locking member in opposition to the biasing force and to an unlocked position, wherein a first pressure moves the locking member to an open position and a second pressure keeps the locking member at the open position, and wherein the first pressure is greater than the second pressure; and the locking member unblocking a piston chamber port extending to a piston chamber, wherein the pressurized fluid travels into the piston chamber and causes the retraction of the piston rod, wherein the pressurized fluid is introduced into the piston chamber and the piston rod is retracted only after the at least one lock is unlocked.

13. The method of claim 12, with the piston rod of the locking piston assembly being locked in at least a substantially fully extended position by the lock.

14. The method of claim 12, with the piston rod of the locking piston assembly being locked in at least a substantially filly retracted position by the lock.

15. The method of claim 12, wherein the moving moves the locking member substantially out of engagement with a latch ring extending from a piston head that is coupled to the piston rod.

16. The method of claim 12, wherein the moving moves the locking member substantially before an extension or retraction force is placed on the piston rod.

17. The method of claim 12, with the unblocking occurring during an opening travel of the locking member.

18. The method of claim 12, with the unblocking occurring substantially at an end of an opening travel of the locking member.

* * * * *